US005626492A

United States Patent [19]

Onizuka et al.

[11] Patent Number: 5,626,492

[45] Date of Patent: May 6, 1997

[54] BUS BAR CONSTRUCTION OF ELECTRICAL CONNECTION BOX

[75] Inventors: Takahiro Onizuka; Jun Yamaguchi, both of Yokkaichi, Japan

[73] Assignee: Sumitomo Wiring Systems, Ltd., Yokkaichi, Japan

[21] Appl. No.: 316,723

[22] Filed: Oct. 3, 1994

[30] Foreign Application Priority Data

Nov. 22, 1993 [JP] Japan ..... 5-292254

[51] Int. Cl.[6] ..... H01R 9/24

[52] U.S. Cl. ..... 439/512; 29/876; 439/949

[58] Field of Search ..... 439/76.2, 212, 439/723, 724, 949, 507, 512, 513; 29/845, 884, 876

[56] References Cited

U.S. PATENT DOCUMENTS 5,160,274 11/1992 Ozaki et al. ..... 439/212
5,207,591 5/1993 Ozaki et al. ..... 439/949
5,295,847 3/1994 Ozaki et al. ..... 439/212
5,295,858 3/1994 Kasai et al. ..... 439/404
5,490,794 2/1996 Kobayashi et al. ..... 439/212

*Primary Examiner*—Neil Abrams
*Attorney, Agent, or Firm*—Greenblum & Bernstein P.L.C.

[57] ABSTRACT

A bus bar construction of an electrical connection box, comprising: a plurality of m and n (m=integer≧2, n=integer≧2) bus bar pieces in each of which a predetermined number of substantially H-shaped bus bars are arranged in series at a preset pitch and intermediate portions of neighboring ones of the bus bars are linked with each other; the bus bars each having an upper portion formed with a first slot and a lower portion formed with a second slot; the m bus bar pieces being arranged longitudinally in m columns; the n bus bar pieces being arranged laterally in n rows on the m bus bar pieces so as to fit the second slots of the n bus bar pieces into the first slots of the m bus bar pieces h=from above such that the m and n bus are pieces are assembled with each other in latticed shape. The intermediate portions of each of the n bus bar pieces is then cut off in accordance with a necessary circuit pattern. Subsequently, the m and n bus bar pieces are press fitted into a casing of the electrical connection box.

4 Claims, 4 Drawing Sheets

BUS BAR CONSTRUCTION OF ELECTRICAL CONNECTION BOX

BACKGROUND OF THE INVENTION

The present invention relates to a bus bar construction of an electrical connection box, in which bus bars are inserted into connectors of wiring harnesses for a motor vehicle so as to be connected thereto for branch connection.

In an electrical connection box such as a branch joint box used for connecting wiring harnesses for a motor vehicle to various electrical devices through branching, a branch connection point is concentrated at one spot so as to perform branch connection of wiring reasonably and economically. In response to recent rise of wiring density of the wiring harnesses, various electrical connection boxes are developed in accordance with models of motor vehicles and use applications.

Bus bars forming a circuit pattern according to models of motor vehicles and use applications are accommodated in a casing of the branch joint box and have tabs acting as male terminals inserted into female connectors of the wiring harnesses so as to be connected to the female connectors.

In the conventional electrical connection box, the bus bars are disposed horizontally or vertically and portions of each bus bar are bent from a linear body of each bus bar in accordance with circuit pattern so as to impart function of branch connection to the bent portions.

However, in the known electrical connection box, since circuits conforming to requirements of wiring harnesses, respectively are formulated, lengths of the linear bodies of the bus bars and locations of bending for the bent portions of the bus bars vary according to the circuits. Therefore, the number of kinds of the bus bars increases, so that a number of dies for molding the bus bars are required to be prepared, thus resulting in rise of cost of the molding dies. Furthermore, since the bus bars are manually mounted on the casing of the electrical connection box one by one, operation of mounting the bus bars on the casing has many drawbacks such as high cost and low efficiency.

SUMMARY OF THE INVENTION

Accordingly, an essential object of the present invention is to provide a bus bar construction of an electrical connection box, which can be produced at low cost and has a wide range of applications.

In order to accomplish this object of the present invention, a bus bar construction of an electrical connection box, according to a first embodiment of the present invention comprises: a plurality of m and n (m=integer≧2, n=integer≧2) bus bar pieces in each of which a predetermined number of substantially H-shaped bus bars are arranged in series at a preset pitch and intermediate portions of neighboring ones of the bus bars are linked with each other; the bus bars each having an upper portion formed with a first slot and a lower portion formed with a second slot; the m bus bar pieces being arranged longitudinally in m columns; the n bus bar pieces being arranged laterally in n rows on the m bus bar pieces so as to fit the second slots of the n bus bar pieces into the first slots of the m bus bar pieces from above such that the m and n bus bar pieces are assembled with each other in latticed shape; the intermediate portions of each of the n bus bar pieces being cut off in accordance with a necessary circuit pattern such that the m and n bus bar pieces are press fitted into a casing of the electrical connection box.

Meanwhile, a bus bar construction of an electrical connection box, according to a second embodiment of the present invention comprises: a plurality of m (m=integer≧2) bus bar pieces in each of which a predetermined number of bus bars are arranged in series at a preset pitch; the bus bars each having an upper portion formed with a first slot and a lower portion formed with a second slot; a plurality of n (n=integer≧2) terminal pieces in each of which a predetermined number of substantially A-shaped terminals are arranged in series at a preset pitch and intermediate portions of neighboring ones of the terminals are linked with each other; the terminals each including an upper portion having a terminal and a lower portion formed with a slot; the m bus bar pieces being arranged longitudinally in m columns; the n terminal pieces being arranged laterally in n rows on the m bus bar pieces so as to fit the slots of the n terminal pieces into the first slots of the m bus bar pieces from above such that the m bus bar pieces and the n terminal pieces are assembled with each other in latticed shape; the intermediate portions of each of the n terminal pieces being cut off in accordance with a necessary circuit pattern such that the m bus bar pieces and the n terminal pieces are press fitted into a casing of the electrical connection box.

In accordance with the present invention, a number of the bus bars are continuously formed by a press and are cut to a plurality of the m and n (m=integer≧2, n=integer≧2) bus bar pieces at an interval of a predetermined number of the bus bars. Then, the m bus bar pieces are arranged longitudinally in the m columns, while the n bus bar pieces are arranged laterally in the n rows on the m bus bar pieces so as to fit the slots of the n bus bar pieces into the slots of the m bus bar pieces from above such that the m and n bus bar pieces are assembled with each other in latticed shape. Subsequently, the intermediate portions of each of the n bus bar pieces are cut off in accordance with the circuit pattern and finally, the assembled m and n bus bar pieces are press fitted into the casing of the electrical connection box.

Meanwhile, a number of the bus bars are continuously formed by a press and are cut to a plurality of the m (m=integer≧2) bus bar pieces at an interval of a predetermined number of the bus bars. Furthermore, a number of the terminals are continuously formed by a press and are cut to a plurality of the n (n=integer≧2) terminal pieces at an interval of a predetermined number of the terminals. Then, the m bus bar pieces are arranged longitudinally in the m columns and the n terminal pieces are arranged laterally in the n rows on the m bus bar pieces so as to fit the slots of the n terminal pieces into the slots of the m bus bar pieces from above such that the m bus bar pieces and the n terminal pieces are assembled with each other in latticed shape. Thereafter, the intermediate portions of each of the n terminal pieces are cut off in accordance with a circuit pattern and finally, the assembled m bus bar pieces and n terminal pieces are press fitted into the casing of the electrical connection box.

Accordingly, in the present invention, length of the bus bar pieces or the terminal pieces to be produced may be restricted to only one kind, thereby resulting in reduction of kinds of their length. Meanwhile, since hitherto required bending operation becomes unnecessary, cost of molding dies can be reduced. Furthermore, since the assembled bus bar pieces or the assembled bus bar pieces and terminal pieces can be press fitted into the casing of the electrical connection box at one stroke, assembly cost is lowered. Furthermore, since the upper and lower bus bar pieces or the terminal pieces and the bus bar pieces are fitted into each other vertically, a female connector of a wiring harness can be connected to the casing from above and below the casing. In addition, since latticed wiring can be performed easily by the upper and lower bus bar pieces or the terminal pieces and the bus bar pieces, circuit changes are facilitated, thereby resulting in improvement of versatility.

BRIEF DESCRIPTION OF THE DRAWINGS

This object and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
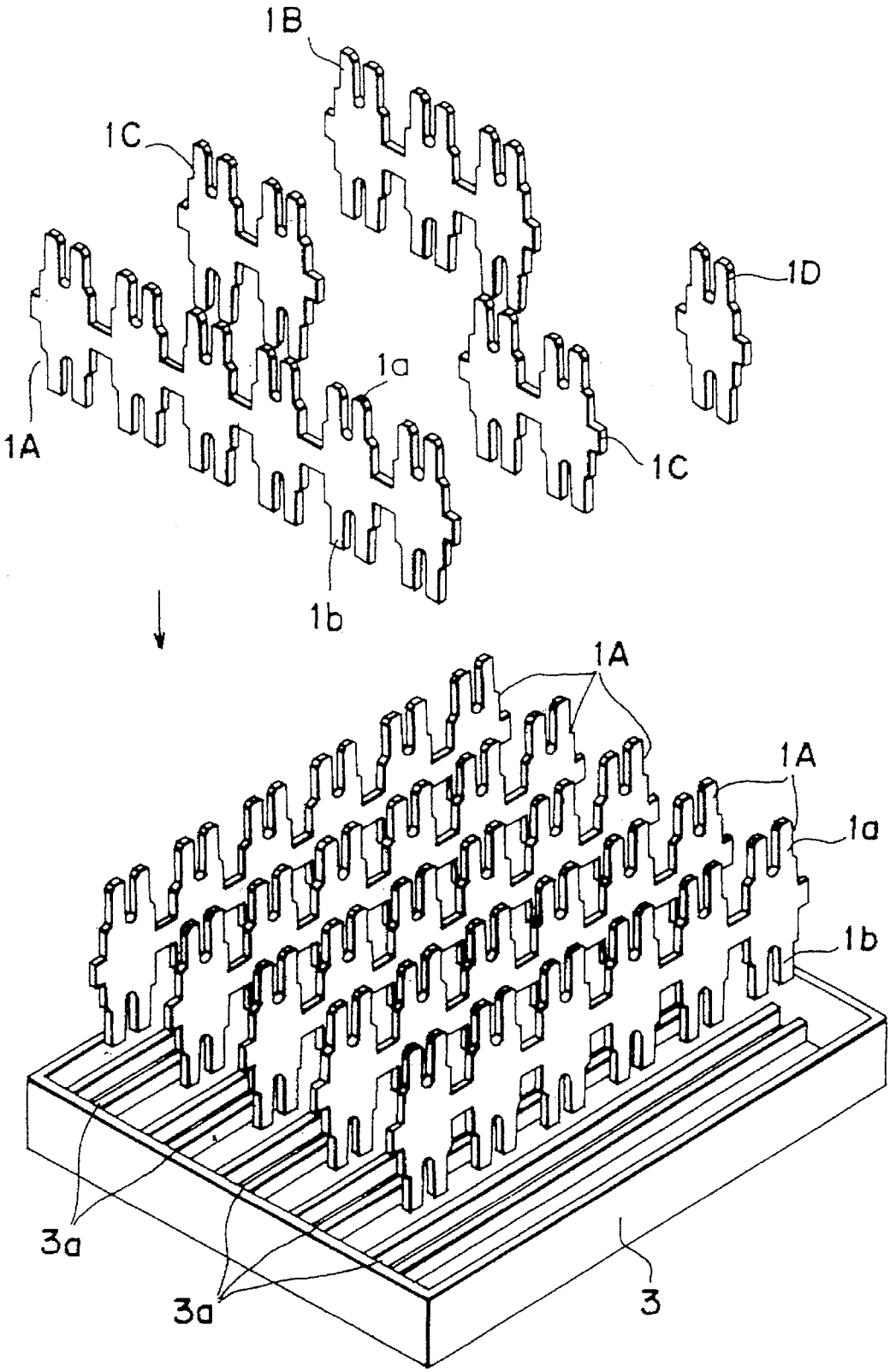
FIG. 1 is an exploded perspective view of a bus bar construction of an electrical connection box, according to a first embodiment of the present invention.
Figure 2:
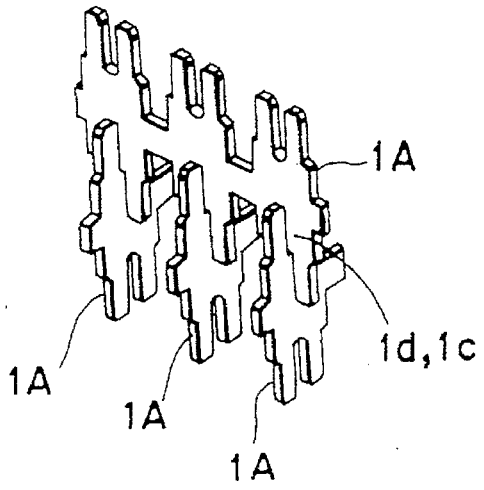
FIG. 2 is a fragmentary perspective view showing latticed assembly of orthogonally intersecting bus bar pieces employed in the bus bar construction of FIG. 1.
Figure 3:
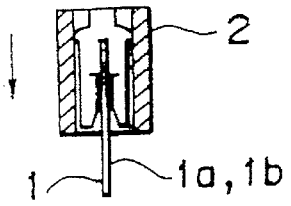
FIG. 3 is a sectional view showing a state in which a bus bar of the bus bar piece of FIG. 2 is inserted into a female connector of a wiring harness.
Figure 4:
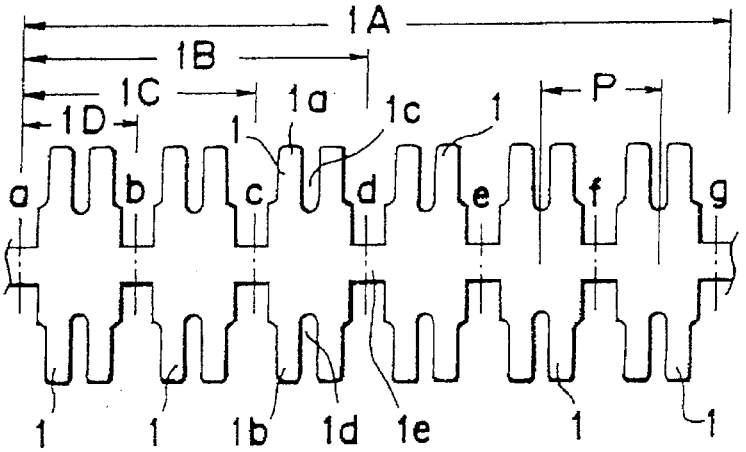
FIG. 4 is a front elevational view of the bus bar piece of FIG. 2.

Referring now to the drawings, there is shown in FIGS. 1 to 4, a bus bar construction of an electrical connection box, according to a first embodiment of the present invention. As shown in FIG. 1, the electrical connection box includes a casing 3. As shown in FIG. 4, each of bus bars 1 has a substantially H-shaped configuration and includes an upper portion 1*a* formed with a slot 1*c* and a lower portion 1*b* formed with a slot 1*d*. By blanking a narrow metal strip continuously at a predetermined pitch P by a press such that intermediate portions 1*e* of neighboring ones of the bus bars 1 are linked with each other, a number of the bus bars 1 are obtained. These bus bars 1 are wound into a reel during blanking.

Then, predetermined numbers of the bus bars 1 are cut off at the intermediate portions 1*e* such that bus bar pieces 1A, 1B, 1C and 1D are obtained. For example, if the bus bars 1 are cut off along cutting lines a and g, the bus bar piece 1A having six bus bars 1 is obtained. When the bus bars 1 are cut off along cutting lines a and d, the bus bar piece 1B having three bus bars 1 is obtained. Meanwhile, in case the bus bars 1 are cut off along cutting lines a and c, the bus bar piece 1C having two bus bars 1 is obtained. Furthermore, if the bus bars 1 are cut off along cutting lines a and b, the bus bar piece 1D having one bus bar 1 is obtained. As shown in FIG. 3, each of the upper and lower portions 1*a* and 1*b* of each bus bar 1 of each of the bus bar pieces 1A–1D is a tab acting as a male terminal and is inserted into a female connector 2 of a wiring harness so as to be connected thereto.

As shown in FIG. 1, five bus bar pieces 1A each having six bus bars 1 are longitudinally arranged in five columns. Then, three bus bar pieces 1A are, respectively, laterally arranged at the first, third and sixth rows of the bus bars 1 of the longitudinal bus bar pieces 1A. As described below, FIG. 1 shows a state after cutting of the lateral bus bar pieces 1A, in which the lateral bus bar piece 1A at the third row of the bus bars 1 of the longitudinal bus bar pieces 1A is replaced by the two lateral bus bar pieces 1C, while the lateral bus bar piece 1A at the sixth row of the bus bars 1 of the longitudinal bus bar pieces 1A is replaced by the lateral bus bar pieces 1B and 1D.

Subsequently, at each of the first, third and sixth rows of the bus bars 1 of the five longitudinal bus bar pieces 1A, the slot 1*d* of the lower portion 1*b* of each bus bar 1 of the three lateral bus bar pieces 1A is fitted into the slot 1*c* of the upper portion 1*a* of each bus bar of the longitudinal bus bar pieces 1A in crossed shape from above. Thus, the upper lateral bus bar pieces 1A and the lower longitudinal bus bar pieces 1A are assembled with each other in latticed shape as shown in FIG. 2.

Thereafter, the intermediate portions 1*e* of the upper lateral bus bar pieces 1A are cut off at one stroke by a press in accordance with a necessary circuit pattern. In the example of FIG. 1, the intermediate portions 1*e* between the second and third bus bars 1 and between the fourth and fifth bus bars 1 from left in the upper lateral bus bar piece 1A disposed at the third row of the bus bars 1 of the longitudinal bus bar pieces 1A are cut off and thus, the two bus bar pieces 1C each having two bus bars 1 are obtained. Meanwhile, the intermediate portions 1*e* between the third and fourth bus bars 1 and between the fifth and sixth bus bars 1 from left in the upper lateral bus bar piece 1A disposed at the sixth row of the bus bars 1 of the longitudinal bus bar pieces 1A are cut off, so that the bus bar pieces 1B and 1D having three bus bars 1 and one bus bar 1, respectively are obtained.

Finally, the lower portions 1*b* of the lower longitudinal bus bar pieces 1A with which the upper lateral bus bar pieces 1A–1D are assembled are press fitted into hollows 3*a* of the casing 3 of the electrical connection box at one stroke.

Consequently, in the first embodiment, since it is merely necessary to produce only one kind of the bus bar pieces 1A having six bus bars 1, kinds of the necessary bus bar pieces to be prepared is reduced greatly. Meanwhile, the need for bending operation required in conventional bus bars is eliminated. Furthermore, since the lower longitudinal bus bar pieces 1A can be press fitted into the casing 3 of the electrical connection box together with the upper lateral bus bar pieces 1A at one stroke, assembly cost is lowered.

Meanwhile, since the upper lateral bus bar pieces 1A and the lower longitudinal bus bar pieces 1A are assembled with each other vertically in the casing 3, the female connector 2 of the wiring harness can be connected to the upper and lower bus bar pieces 1A from above and below the casing 3. Furthermore, since latticed wiring can be easily performed by the upper and lower bus bar pieces 1A, circuit can be easily changed by merely changing positions for cutting off the intermediate portions 1*e*, thereby resulting in remarkable improvement of versatility.

Figure 5:
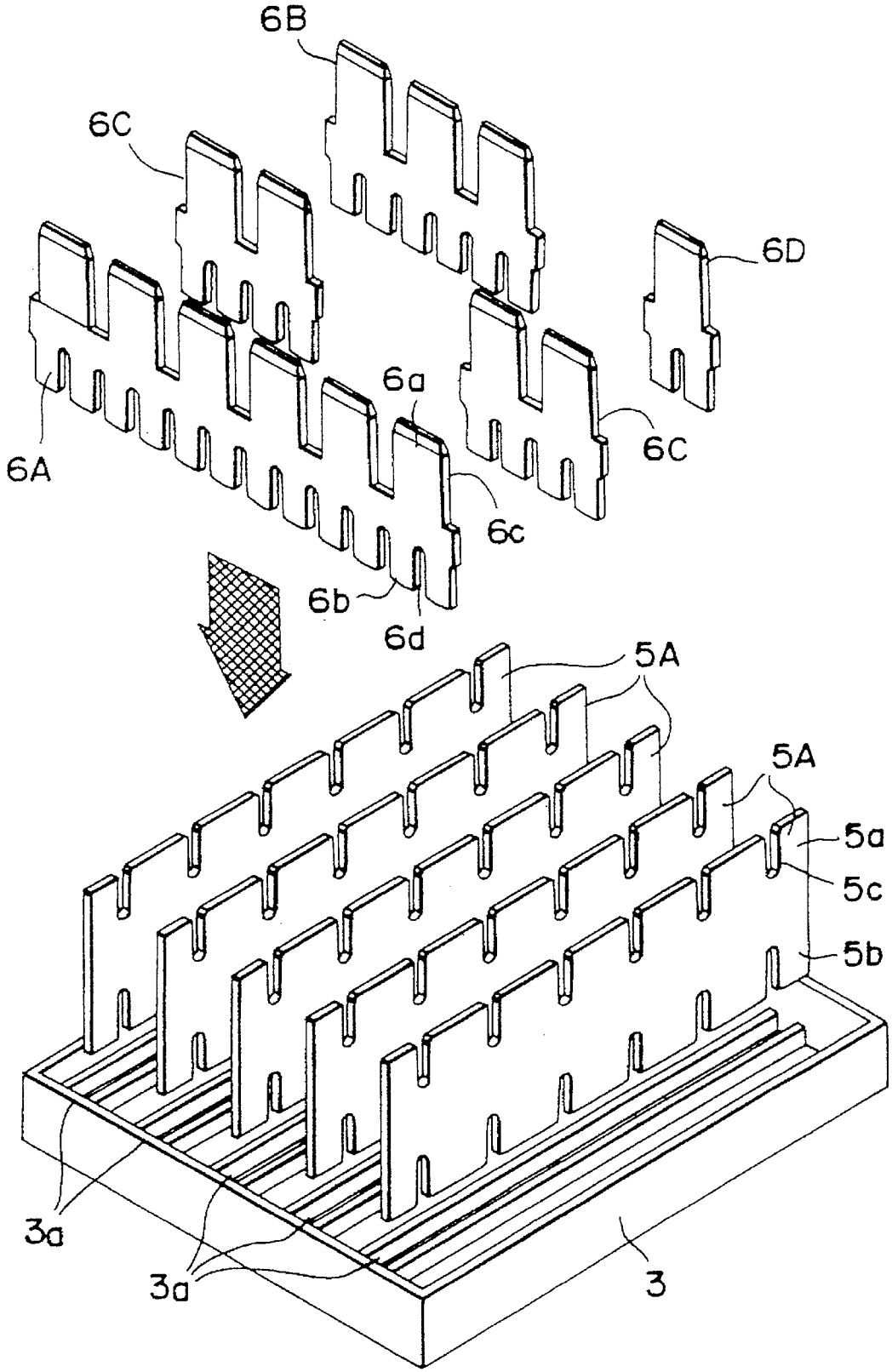
FIG. 5 is an exploded perspective view of a bus bar construction of an electrical connection box, according to a second embodiment of the present invention.
Figure 6:
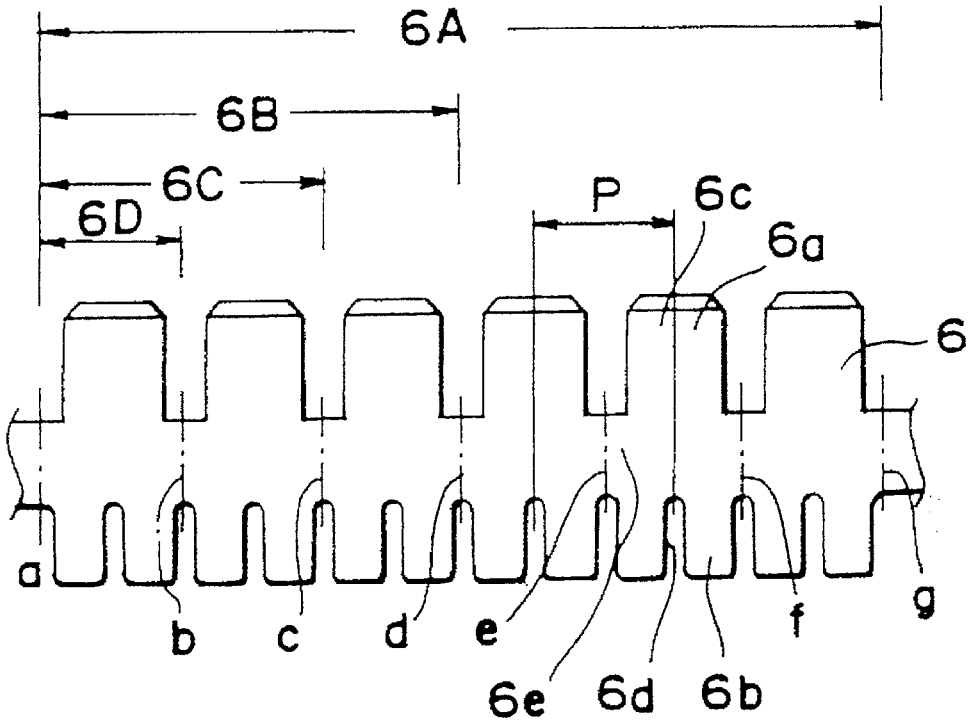
FIG. 6 is a front elevational view of a terminal piece employed in the bus bar construction of FIG. 5.
Figure 7:
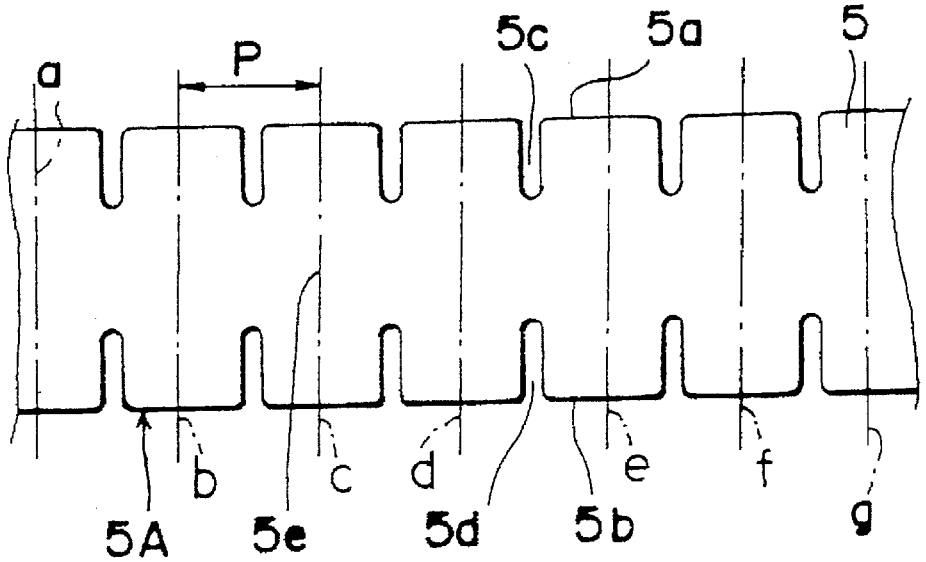
FIG. 7 is a front elevational view of a bus bar piece employed in the bus bar construction of FIG. 5.

FIGS. 5 to 7 show a bus bar construction of an electrical connection box, according to a second embodiment of the present invention. As shown in FIG. 7, each of bus bars 5 has a substantially H-shaped configuration and includes an upper portion 5*a* formed with a slot 5*c* and a lower portion 5*b* formed with a slot 5*d*. By blanking a narrow metal strip continuously at a predetermined pitch by a press such that intermediate portions 5*e* of neighboring ones of the bus bars 5 are linked with each other, a number of the bus bars 5 are obtained. These bus bars 5 are wound into a reel during blanking.

Meanwhile, as shown in FIG. 6, each of terminals 6 has a substantially A-shaped configuration and includes an upper portion 6*a* having a terminal portion 6*c* and a lower portion 6*b* formed with a slot 6*d*. By blanking a narrow metal strip continuously at a predetermined pitch by a press such that intermediate portions 6*e* of neighboring ones of the terminals 6 are linked with each other, a number of the terminals 6 are obtained. These terminals 6 are wound into a reel during blanking.

When a series of these bus bars 5 are cut off at the intermediate portions 5*e* at an interval of a predetermined number of the bus bars 5, a bus bar piece 5A is obtained. For example, when the bus bars 5 are cut off along cutting lines a and g in FIG. 7, the bus bar piece 5A has six bus bars 5. Meanwhile, when a series of the terminals 6 are cut off at the intermediate portions 6*e* at an interval of predetermined numbers of the terminals 6, terminal pieces 6A to 6D are obtained. For example, if the terminals 6 are cut off along cutting lines a and g in FIG. 6, the terminal piece 6A having six terminals 6 are obtained. When the terminals 6 are cut off along cutting lines a and d, the terminal piece 6B having three terminals 6 is obtained. Meanwhile, in case the terminals 6 are cut off along cutting lines a and c, the terminal piece 6C having two terminals 6 is obtained. Furthermore, if the terminals 6 are cut off along cutting lines a and b, the terminal piece 6D having one terminal 6 is obtained. In the same manner as the first embodiment, the terminal portion 6*c* disposed at the upper portion 6*a* of each of the terminal pieces 6A to 6D is a tab acting as a male terminal and is inserted into the female connector 2 of the wiring harness so as to be connected thereto.

After five bus bar pieces 5A each having six bus bars 5 have been arranged longitudinally in five columns as shown in FIG. 5, three terminal pieces 6A each having six terminals 6 are, respectively, are laterally arranged at the first, third and sixth rows of the bus bars 5 of the longitudinal bus bar pieces 5A. In FIG. 5, the terminal pieces 6B to 6D each obtained by cutting off the terminals 6 of the terminal piece 6A are shown at the third and sixth rows of the bus bars 5 of the longitudinal bus bar pieces 5A.

Subsequently, at each of the first, third and sixth rows of the bus bars 5 of the five longitudinal bus bar pieces 5A, the slot 6*d* of the lower portion 6*b* of each terminal 6 of the three lateral terminal pieces 6A is fitted into the slot 5*c* of the upper portion 5*a* of each bus bar 5 of the longitudinal bus bar pieces 5A in crossed shape from above. Thus, in the same manner as the first embodiment, the upper lateral terminal pieces 6A and the lower longitudinal bus bar pieces 5A are assembled with each other in latticed shape.

Thereafter, the intermediate portions 6*e* of the upper lateral terminal pieces 6A are cut off at one stroke by a press in accordance with a necessary circuit pattern. In the example of FIG. 5, the intermediate portions 6*e* between the second and third terminals 6 and between the fourth and fifth terminals 6 from left in the upper lateral terminal piece 6A disposed at the third row of the bus bars 5 of the longitudinal bus bar pieces 5A are cut off and thus, the two terminal pieces 6C each having two terminals 6 are obtained. Meanwhile, the intermediate portions 6*e* between the third and fourth terminals 6 and between the fifth and sixth terminals 6 from left in the upper lateral terminal piece 6A disposed at the sixth row of the bus bars 5 of the longitudinal bus bar pieces 5A are cut off, so that the terminal pieces 6B and 6D having three terminals 6 and one terminal 6, respectively are obtained.

Finally, the lower portions 5*b* of the lower longitudinal bus bar pieces 5A with which the upper lateral terminal pieces 6A–6D are assembled are press fitted into the hollows 3*a* of the casing 3 of the electrical connection box at one stroke.

As is clear from the foregoing description of the bus bar construction of the electrical connection box, according to the present invention, the bus bars or the terminals are formed continuously as a continuous strip by using a press so as to produce the bus bar piece or the terminal piece by cutting off the continuous strip at an interval of a predetermined number of the bus bars or the terminals. Then, a plurality of the bus bar pieces or the terminal pieces are arranged longitudinally in a plurality of columns and laterally in a plurality of rows. Thus, the slots of the longitudinal and lateral bus bar pieces or terminal pieces are vertically fitted into each other such that the longitudinal and lateral bus bar pieces or terminal pieces are assembled with each other in latticed shape. Subsequently, after the intermediate portions of the upper bus bar pieces or terminal pieces have been cut off at one stroke so as to form a necessary circuit pattern, the assembled bus bar pieces or terminal pieces are press fitted into the casing of the electrical connection box.

In accordance with the present invention, since the bus bar pieces or the terminal pieces, which have only one kind of length, may be produced, kinds of the bus bars or the terminal pieces is reduced. Meanwhile, since hitherto required bending operation becomes unnecessary, cost of molding dies is lowered. Furthermore, since the assembly of the bus bar pieces with the bus bar pieces or terminal pieces can be press fitted into the casing of the electrical connection box at one stroke, assembly cost is lessened. In addition, since the bus bar pieces are fitted into the bus bar pieces or the terminal pieces vertically, the female connector of the wiring harness can be connected to the casing of the electrical connection box from above and below the casing. Moreover, since latticed wiring can be easily performed by the assembly of the bus bar pieces with the bus bar pieces or the terminal pieces, the circuit can be changed easily, thereby resulting in improvement of versatility.

What is claimed is:

1. A bus bar construction of an electrical connection box, comprising:

a plurality of m and n (m=integer≧2, n=integer≧2) bus bar pieces in each of which a predetermined number of substantially H-shaped bus bars are arranged in series at a preset pitch and intermediate portions of neighboring ones of the H-shaped bus bars are linked with each other;

the H-shaped bus bars each having an upper portion formed with a first slot and a lower portion formed with a second slot;

the m bus bar pieces being arranged longitudinally in m columns;

the n bus bar pieces being arranged laterally in n rows on the m bus bar pieces so as to fit the second slots of the n bus bar pieces into the first slots of the m bus bar pieces from above such that the m and n bus bar pieces are assembled with each other in latticed shape; and the intermediate portions of each of the n bus bar pieces being cut off in accordance with a necessary circuit pattern and the m and n bus bar pieces are press fitted into a casing of the electrical connection box.

2. A bus bar construction of an electrical connection box, comprising:

a plurality of m (m=integer≧2) bus bar pieces in each of which a predetermined number of bus bars are arranged in series at a preset pitch;

the bus bars each having an upper portion formed with a first slot and a lower portion formed with a second slot;

a plurality of n (n=integer≧2) terminal pieces in each of which a predetermined number of substantially A-shaped terminals are arranged in series at a preset pitch and intermediate portions of neighboring ones of the terminals are linked with each other;

the A-shaped terminals each including an upper portion having a connection terminal and a lower portion formed with a slot;

the m bus bar pieces being arranged longitudinally in m columns;

the n terminal pieces being arranged laterally in n rows on the m bus bar pieces so as to fit the slots of the n terminal pieces into the first slots of the m bus bar pieces from above such that the m bus bar pieces and the n terminal pieces are assembled with each other in latticed shape; and the intermediate portions of each of the terminal pieces being cut off in accordance with a necessary circuit pattern and the m bus bar pieces and the n terminal pieces are press fitted into a casing of the electrical connection box.

3. A method of producing a bus bar construction of an electrical connection box, comprising the steps of:

forming continuously at a preset pitch by a press, a number of substantially H-shaped bus bars in which intermediate portions of neighboring ones of the bus bars are linked with each other;

the bus bars each having an upper portion formed with a first slot and a lower portion formed with a second slot;

cutting off the intermediate portions of the bus bars at an interval of a predetermined number of the bus bars so as to obtain a plurality of m and n (m=integer≧2, n=integer≧2) bus bar pieces;

arranging the m bus bar pieces longitudinally in m columns;

arranging the n bus bar pieces laterally in n rows on the m bus bar pieces so as to fit the second slots of the n bus bar pieces into the first slots of the m bus bar pieces from above such that the m and n bus bar pieces are assembled with each other in latticed shape;

cutting off the intermediate portions of each of the n bus bar pieces in accordance with a necessary circuit pattern at one stroke; and press fitting the m and n bus bar pieces into a casing of the electrical connection box at one stroke.

4. A method of producing a bus bar construction of an electrical connection box, comprising the steps of:

forming continuously at a preset pitch by a press, a number of bus bars each having an upper portion formed with a first slot and a lower portion formed with a second slot;

cutting the bus bars at an interval of a predetermined number of the bus bars so as to obtain a plurality of m (m=integer≧2) bus bar pieces;

forming continuously at a preset pitch by a press, a number of substantially A-shaped terminals in which intermediate portions of neighboring ones of the terminals are linked with each other;

the terminals each including an upper portion having a terminal and a lower portion formed with a slot;

cutting off the intermediate portions of the terminals at an interval of a predetermined number of the terminals so as to obtain n (n=integer≧2) terminal pieces;

arranging the m bus bar pieces longitudinally in m columns;

arranging the n terminal pieces laterally in n rows on the m bus bar pieces so as to fit the slots of the n terminal pieces into the first slots of the m bus bar pieces from above such that the m bus bar pieces and the n terminal pieces are assembled with each other in latticed shape;

cutting off the intermediate portions of each of the n terminal pieces in accordance with a necessary circuit pattern at one stroke; and press fitting the m bus bar pieces and the n terminal pieces into a casing of the electrical connection box at one stroke.

* * * * *